US005463989A

United States Patent [19]

Sääf et al.

[11] Patent Number: 5,463,989

[45] Date of Patent: Nov. 7, 1995

[54] REINFORCED CYLINDER HEAD

[75] Inventors: Lars Sääf, Södertälje; Sven E. Stenfors, Enskede, both of Sweden

[73] Assignee: Saab Automobile Aktiebolag, Sweden

[21] Appl. No.: 355,674

[22] Filed: Dec. 14, 1994

[30] Foreign Application Priority Data

Dec. 16, 1993 [SE] Sweden ..... 930179

[51] Int. Cl.[6] ..... F02F 1/26

[52] U.S. Cl. ..... 123/193.5

[58] Field of Search ..... 123/193.5, 195 H

[56] References Cited

U.S. PATENT DOCUMENTS

| | | | |
|---|---|---|---|
| 3,699,852 | 10/1972 | Howe | 123/193.5 |
| 4,337,735 | 7/1982 | Lichtner et al. | 123/193.5 |
| 4,387,678 | 6/1983 | Tholen | 123/193.3 |
| 4,422,803 | 4/1984 | Tholen | 123/193.3 |
| 4,465,041 | 8/1984 | Hayashi | 123/195 R |
| 4,630,345 | 12/1986 | Lutz | 123/193.3 |
| 4,739,738 | 4/1988 | Sander et al. | 123/193.6 |
| 4,936,270 | 6/1990 | Ushio et al. | 123/90.39 |
| 5,069,266 | 12/1991 | Nakatani et al. | 164/112 |

FOREIGN PATENT DOCUMENTS

| | | |
|---|---|---|
| 0595676 | 10/1993 | European Pat. Off. . |
| 2059230 | 8/1970 | France . |
| 3545098 | 9/1986 | Germany . |
| 3837254 | 11/1988 | Germany . |
| 63-272950 | 11/1988 | Japan . |

*Primary Examiner*—David A. Okonsky

*Attorney, Agent, or Firm*—Ostrolenk, Faber, Gerb & Soffen

[57] ABSTRACT

A cast cylinder head of light metal incorporates a reinforcement made of a stronger material than the light metal. The reinforcement consists of a relatively narrow elongated steel plate (6) which stretches in a single piece along all the cylinders. The elongated steel plate (6) is provided with transverse arms (8) which stretch out approximately perpendicularly from the steel plate between the valve port apertures (3*a*, 4*a*, 5*a*, 6*a*) of each cylinder.

14 Claims, 3 Drawing Sheets

REINFORCED CYLINDER HEAD

The invention relates to a reinforced cylinder head which is for a combustion engine and which is cast in a light metal alloy such as aluminium and aluminium alloys.

STATE OF THE ART

Development work is continually going on within the vehicle industry with a view to improving the ratio between the power output and weight of vehicle engines. This endeavour has resulted inter alia in improvements with regard to the geometrical design of combustion chambers, ignition control and further development of the fuel supply and exhaust gas systems. The majority of today's combustion engines thus incorporate several inlet and exhaust gas ports per engine cylinder; there are normally four ports comprising two inlet ports and two exhaust gas ports for each cylinder. These ports are usually arranged symmetrically in a four-leaf clover pattern about the central axis of each cylinder.

In parallel with the endeavour to increase engine power output, there has been an endeavour to reduce engine weight. The weight decrease which has been achieved and which has led to light combustion engines has primarily arisen because it has been possible for new casting material consisting of high-quality light metal alloys to be used for making engine castings. The weight reduction is offset, however, by the fact that the endeavour to increase engine power output involves, for example, a larger number of valve ports and mechanical weakening of the cylinder head. There is therefore an interdependence between the two endeavours. Increasing the engine power output requires better strength characteristics in the material used, which tends to conflict with the desire to reduce engine weight.

Modern high-quality light metal alloys have a substantial disadvantage in that they are considerably more expensive than traditional materials, thereby increasing engine production costs.

In combustion engines the greatest material stresses occur around the cylinders, since it is precisely in this area that the thermal and mechanical load gradients are greatest. In multi-valve engines the strength problem is further exacerbated by the fact that the ports have of necessity to be located here, which reduces the volume of material available for power absorption and heat dissipation in the most exposed area.

OBJECT OF THE INVENTION

The object of the invention is to indicate a solution which results in better utilisation of material from the strength point of view, so that the light metal material is relieved of stress in the most exposed areas, so that the same engine power output can be extracted while using a less expensive alloy material or a higher power output can be extracted while continuing to use a high-quality casting material.

This is achieved with a cylinder head of the type defined in the introduction by incorporating an elongated reinforcing plate which is made of a mechanically stronger material than the light metal and is embedded in the light metal so as to stretch in a single piece along all the cylinders.

The arranging of some form of insert around each cylinder was certainly already known in the 1950s. The real purpose of those inserts is not to provide the host material with greater mechanical strength but simply to use each insert, which ends directly in the cylinder space, to fill the cavity in which it is inserted in order to prevent the latter becoming choked with the residual products which arise from combustion. It is thus the cavity and not the insert material which is primary in the prior art. The cavities stretching to the combustion chamber serve as expansion joints, the primary function of which is to prevent the propagation of cracks which may arise in the material as a result of the great temperature differences which occur in the area around the cylinders.

An example of such a design appears in DE,B, 1 001 860, in which thin sheetmetal rings are arranged concentrically in the area around a cylinder. It also emerges from that publication that various materials are used in this connection, such as mica or thermoplastics, which are known to have no capability for mechanically strengthening the material. The sheetmetal rings which in that publication replace mica or thermoplastic inserts are therefore not intended to absorb any substantial forces.

A similar arrangement is described in U.S. Pat. No. 4,337,735, which is more recent by approximately thirty years. This involves a more developed technique using steel inserts to prevent crack propagation, in combination with an oxide coating to reduce crack formation. However, such steel inserts have likewise no great reinforcing capability for countering mechanical stresses.

It should also be noted that in the known arrangements there are separate inserts, often at least two of them, for each cylinder. This results in cylinder head casting problems pertaining to the alignment and fixing of the inserts in the required position. This problem is further accentuated in the case of multi-cylinder cylinder heads. Working with inserts and the fastening of inserts takes time and requires great precision, with attendant extra costs. In the worst case it may happen that some inserts may be omitted, particularly in multi-cylinder engines, which leads to a substantial reduction in strength.

This problem is eliminated by the reinforcement according to the invention consisting of a single piece for all the cylinders in a multi-cylinder cylinder head.

In a particularly preferred embodiment the elongated reinforcing plate is provided with transverse arms which stretch between the valve ports. This results in further strengthening of the most stressed points.

To improve anchoring in the light metal material, the reinforcement incorporates broadened anchoring portions.

BRIEF DESCRIPTION OF THE DRAWINGS

A more detailed description of a specific embodiment is given below with reference to the attached drawings, in which.

DETAILED DESCRIPTION OF AN EMBODIMENT

Figure 1:
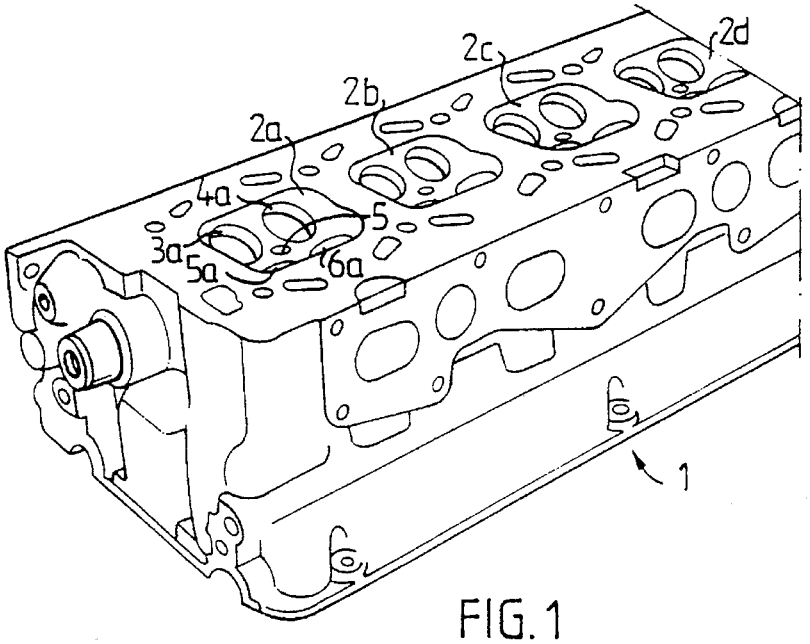
FIG. 1 shows in perspective one end of a cylinder head for a multi-cylinder engine.

FIG. 1 depicts schematically the end portion of a cylinder head 1 in which four combustion chambers 2*a*, 2*b*, 2*c*, 2*d* are visible. Each combustion chamber 2*a* incorporates the orifices of four valve ports 3*a*, 4*a*, 5*a*, 6*a*, but for the sake of clarity only one cylinder is depicted with the references. The other combustion chambers in the cylinder head are of the same design and therefore require no further discussion. Two of the ports are inlet ports, while the other two are exhaust gas ports. As most clearly visible in FIG. 4, the port orifices are arranged substantially symmetrically in a four-leaf clover pattern about the central axis. In the middle of each of the combustion chambers 2*a*, 2*b*, 2*c*, 2*d* there is an aperture 5 for an ignition device. The cylinder head 1 also incorporates in the traditional manner (but not depicted in detail) cooling ducts, connections for manifolds, controls for valves, camshaft bearings, etc.

Figure 2:
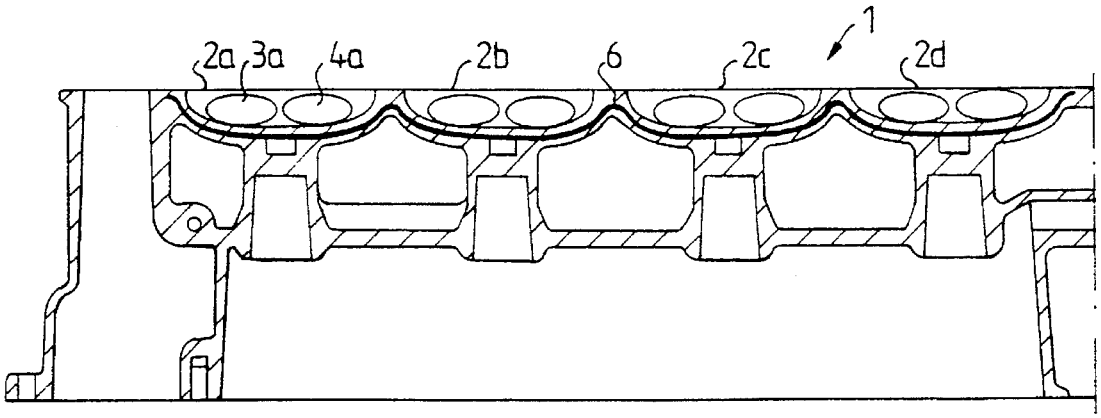
FIG. 2 shows an axial section through the cylinder head depicted in FIG. 1.
Figure 4:
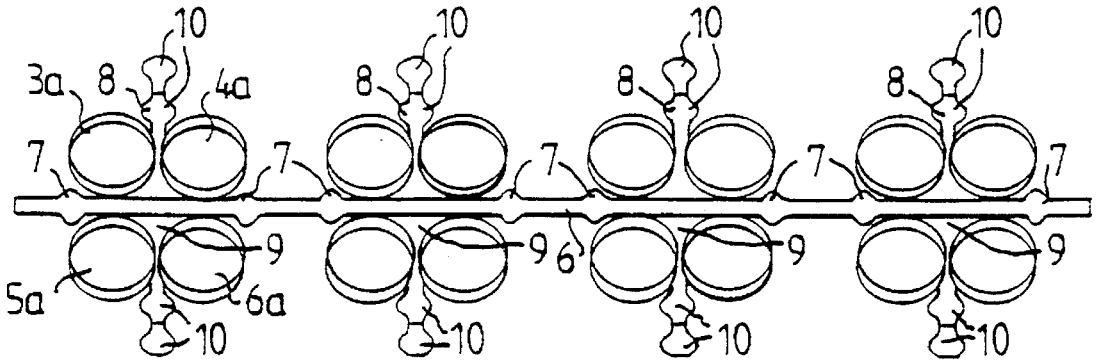
FIG. 4 shows a view from above which for the sake of clarity depicts only the valve port orifices and the reinforcement according to the invention.

An elongated and relatively narrow reinforcing plate 6 stretches, as shown in FIG. 2, along all the cylinders 2*a*, 2*b*, 2*c*, 2*d* and is embedded so as to follow the contours of the combustion chambers at a depth of a few centimeters. As depicted in FIG. 2, the reinforcing plate 6 has an undulating contour. As best visible in FIG. 4, the reinforcing plate 6 stretches in the form of a narrow wavy strip between the central axes of the combustion chambers. To improve the anchoring of the reinforcing plate 6 in the light alloy material, it incorporates enlarged or broadened portions 7 on both sides of each valve port group. For each cylinder there is a transverse arm 8 which is firmly connected, e.g. by riveting or spot welding, to the elongated reinforcement 6. The elongated reinforcement 6 and the transverse arms 8 may also be manufactured as a single piece. The transverse arms 8 start from the region of the combustion chamber central axis and stretch cruciformly out perpendicularly from both sides of the reinforcing plate 6 (FIG. 4). The middle portion 9 of the transverse arms 8 is enlarged to improve the strengthening effect in the central region. The middle portion 9 is also provided with a hole (not shown in the figures) running through it for an ignition device. The transverse arms 8 also incorporate, exactly as the reinforcing plate 6 does, enlarged or broadened portions 10 to improve the anchoring in the host material.

Figure 3:
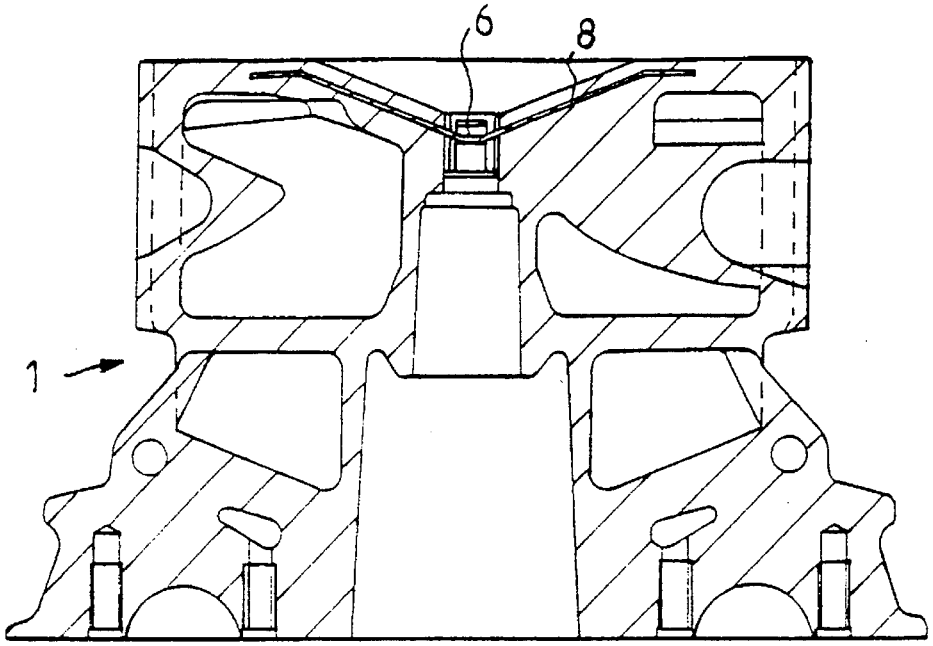
FIG. 3 shows a cross-section on a somewhat larger scale through the cylinder head depicted in FIG. 2.

As may be seen in FIG. 3, the transverse arms 8 also follow the cylinder head contour and form a spread V-shape in a section perpendicular to the central axis of the cylinder head 1 between the ports. There is thus a reinforcing element along each valve port aperture, while the region around the central axis of the cylinders contains a large reinforcement portion 9. The reinforcing structure according to the invention thus provides the weakest portions with effective strengthening, while the fitting and fastening of the reinforcement in the casting mould remains extremely easy because the structure is cast in a single piece.

The material of the reinforcement is of course stronger than the light metal alloy casting which constitutes the cylinder head 1. It is advantageous for the reinforcement to be made of steel plate but other materials may of course be considered.

To improve bonding between the cast-in reinforcement and the host material, the reinforcement may be protected with a fusible coating which has a lower melting point than the light metal alloy. The protective alloy will then melt away during the casting process and leave a surface free from oxide.

ALTERNATIVE EMBODIMENTS OF THE INVENTION

It will be obvious to specialists that the reinforcement according to the invention may be modified in various ways within the scope of the patent claims. For example, the reinforcement may incorporate additional broadened portions or be provided with protrusions, holes or flanges for better anchoring in the host material. Its shape may also differ from the narrow strip with rectangular cross-section depicted in the drawings. For example, an oval or circular cross-section is conceivable. There may also be additional transverse arms arranged between the valve port groups etc.

Figure 5:
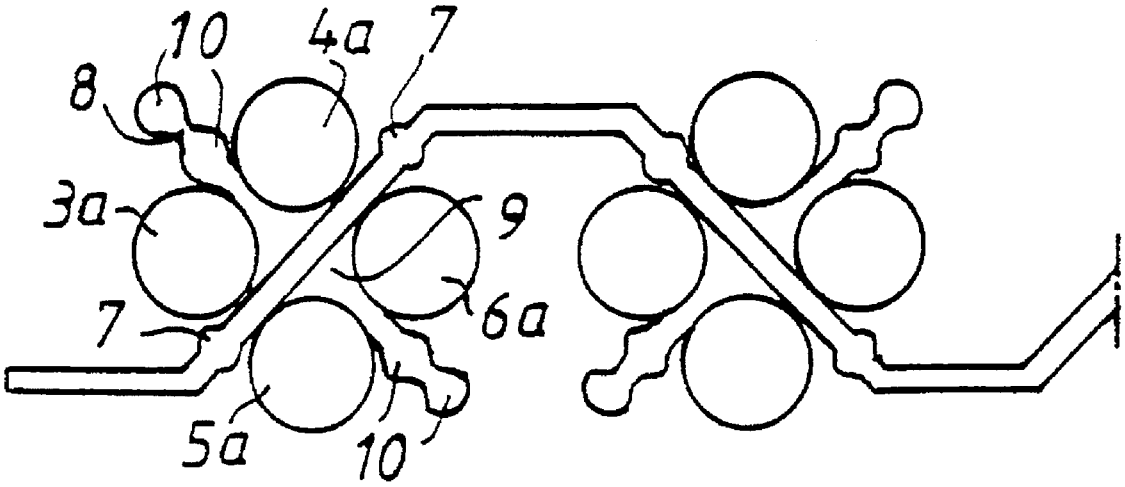
FIG. 5 shows in simplified form an alternative embodiment of the valve port orifices and the reinforcement in FIG. 4.

The port orifices 3*a*, 4*a*, 5*a* and 6*a* are, as previously mentioned, arranged substantially symmetrically in a four-leaf clover pattern about the central axis. FIG. 4 shows one possibility for the placing of the port orifices. It is of course possible to place the port orifices in a different manner, e.g. as shown in FIG. 5, without departing from the four-leaf clover arrangement. In FIG. 5 the reinforcing element is shown stretching, in the same manner as in FIG. 4, between two valve pairs which cooperate with respective cylinder spaces 2*a*, 2*b*, 2*c* and 2*d*, and the transverse arms 8 are shown stretching out from the central axis region between the valve port apertures.

We claim:

1. A multicylinder cylinder head for an internal combustion engine, wherein the cylinder head is comprised of a light metal, and combustion chambers in the cylinder head which are arranged in a pathway along the cylinder head;

a longitudinally extending reinforcing element extending along the cylinder head along the pathway of the combustion chambers, the reinforcing element being imbedded in the metal of the cylinder head and being of a mechanically stronger material than the light metal of the cylinder head.

2. The cylinder head of claim 1, wherein the reinforcing element comprises an elongate, relatively narrow plate which extends past each of the combustion chambers along the pathway of the cylinder head.

3. The cylinder head of claim 2, wherein the reinforcing element is comprised of steel.

4. The cylinder head of claim 2, wherein the reinforcing element has enlarged anchoring portions disposed along the reinforcing element at the combustion chambers in the cylinder head for anchoring the reinforcing element at the cylinder head.

5. The cylinder head of claim 4, further comprising respective transverse arms extending transversely to the reinforcing element at each of the combustion chambers.

6. The cylinder head of claim 5, wherein the transverse arms extend substantially-perpendicular to the longitudinal direction of the pathway of the reinforcing element.

7. The cylinder head of claim 6, wherein each combustion chamber in the cylinder head includes a cylinder space having a central axis; a plurality of valve ports for each cylinder space arranged about the central axis of each cylinder space; the reinforcing element extending between at least two of the valve ports for each cylinder space, and the transverse arms extending out from the reinforcing element between at least two of the valve ports.

8. The cylinder head of claim 7, wherein there are four of the valve ports arranged substantially symmetrically about the central axis of each cylinder space;

the valve ports being so placed that the reinforcing element extends between at least two of the valve ports at each cylinder space; and the transverse arms extend from the region of the central axis of the cylinder space, between at least two of the valve ports.

9. The cylinder head of claim 8, wherein the transverse arms include enlarged anchoring portions outward of the cylinder spaces.

10. The cylinder head of claim 8, wherein the transverse arms include enlarged anchoring portions outward of the valve ports.

11. The cylinder head of claim 7, wherein the transverse arms include enlarged anchoring portions outward of the cylinder spaces.

12. The cylinder head of claim 5, wherein each combustion chamber in the cylinder head includes a cylinder space having a central axis; a plurality of valve ports for each cylinder space arranged about the central axis of each cylinder space; the reinforcing element extending between at least two of the valve ports for each cylinder space, and the transverse arms extending out from the reinforcing element between at least two of the valve ports.

13. The cylinder head of claim 11, wherein the combustion chambers in the cylinder head are generally arranged in a row along the cylinder head and the reinforcing element extends along a straight path along the cylinder head past each of the cylinder spaces.

14. The cylinder head of claim 11, wherein the pathway of the combustion chambers along the cylinder head is not a straight path and the reinforcing element has a bent shape to extend along the pathway.

* * * * *